US012256844B2

(12) United States Patent
Shi

(10) Patent No.: US 12,256,844 B2
(45) **Date of Patent: *Mar. 25, 2025**

(54) INFLATABLE BED

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/796,408

(22) Filed: Aug. 7, 2024

(65) Prior Publication Data

US 2025/0049226 A1 Feb. 13, 2025

(30) Foreign Application Priority Data

Aug. 10, 2023 (CN) ..... 202322159834.4

(51) Int. Cl.
*A47C 27/08* (2006.01)
*A47C 27/00* (2006.01)

(52) U.S. Cl.
CPC ..... *A47C 27/082* (2013.01); *A47C 27/006* (2013.01); *A47C 27/087* (2013.01)

(58) Field of Classification Search
CPC .... A47C 27/082; A47C 27/006; A47C 27/087
See application file for complete search history.

(56) References Cited

U.S. PATENT DOCUMENTS

| | | | | |
|---|---|---|---|---|
| 4,700,419 | A * | 10/1987 | Santo | A47C 27/085 5/681 |
| 4,955,095 | A * | 9/1990 | Gerrick | A47C 31/105 5/691 |
| 8,656,539 | B1 * | 2/2014 | Boyd | A47C 27/087 5/713 |
| 10,945,533 | B1 * | 3/2021 | Shi | A47C 27/081 |
| 11,503,920 | B1 * | 11/2022 | Shi | A47C 27/10 |
| 11,969,098 | B1 * | 4/2024 | Shi | A47C 27/087 |
| 11,969,099 | B1 * | 4/2024 | Shi | A47C 27/087 |
| 12,053,095 | B1 * | 8/2024 | Shi | A47C 27/087 |
| 12,108,880 | B2 * | 10/2024 | Shi | A47C 27/087 |
| 2006/0010608 | A1 * | 1/2006 | DeFranks | A47C 27/00 5/738 |
| 2006/0218728 | A1 * | 10/2006 | Liu | A47C 27/10 5/710 |

(Continued)

*Primary Examiner* — Myles A Throop
(74) *Attorney, Agent, or Firm* — Cooper Legal Group, LLC

(57) ABSTRACT

The present application discloses an inflatable bed including a hollow bed body. The hollow bed body includes a top sheet, a perimeter wall, a bottom sheet, and tensioning straps, the top sheet and the bottom sheet cover the perimeter wall up and down, inner supporting assemblies are disposed inside the bed body, each of the inner supporting assemblies includes an inner supporting structure and a breathable mesh, the top of the inner supporting structure is fixed to an inner wall of the top of the bed body, a side wall of the inner supporting structure is fixed to an inner side wall of the bed body, the inside of the bed body is partitioned into an independent main cavity and an auxiliary cavity, the breathable mesh is mounted on the side wall of the inner supporting structure, and the main cavity communicates with the auxiliary cavity.

12 Claims, 10 Drawing Sheets

(56) References Cited

U.S. PATENT DOCUMENTS

| | | | | |
|---|---|---|---|---|
| 2006/0265810 | A1* | 11/2006 | Wu | A47C 27/081<br>5/712 |
| 2015/0335164 | A1* | 11/2015 | Liu | F24F 13/20<br>156/278 |
| 2024/0298813 | A1* | 9/2024 | Shi | A47C 27/087 |

* cited by examiner

A

B

C

D

INFLATABLE BED

CROSS-REFERENCE TO RELATED APPLICATION

The present application claims the priority benefits of China patent application No. 202322159834.4, filed on Aug. 10, 2023. The entirety of China patent application No. 202322159834.4 is hereby incorporated by reference herein and made a part of this specification.

TECHNICAL FIELD

The present application relates to the technical field of inflatable beds, and, in particular, to an inflatable bed.

BACKGROUND ART

Currently, a multi-air-chamber inflatable bed, such as a three-air-chamber inflatable bed, includes a perimeter wall, a top sheet, a bottom sheet, an upper diagonal strap, and a lower diagonal strap. The top sheet and the bottom sheet are both thermally sealed with two peripheral ends, the upper diagonal strap is thermally welded with the top sheet and the perimeter wall simultaneously, the lower diagonal strap is thermally welded with the bottom sheet and the perimeter wall at the same time, and thus, a three-air-chamber structure is formed. In order to communicate with a plurality of air chambers, vent holes are disposed in both the upper diagonal strap and the lower diagonal strap.

However, due to the necessity of forming the vent holes in the upper diagonal strap or the lower diagonal strap of the existing inflatable bed, the process is cumbersome. Moreover, the perimeter wall, the upper diagonal strap and the lower diagonal strap are all made of polyvinyl chloride (PVC) material, which has certain extensibility and malleability, therefore, swelling, bulging and other phenomena are easily caused around the perimeter wall, leading to poor stability and poor comfort in use.

SUMMARY

In order to improve the stability of an overall structure of an inflatable bed, the present application provides an inflatable bed.

The inflatable bed provided by the present application adopts the following technical solution:

the inflatable bed includes a bed body, wherein the bed body is hollow, the bed body includes a top sheet, a perimeter wall, a bottom sheet, and tensioning straps, the top sheet and the bottom sheet cover the perimeter wall up and down, inner supporting assemblies are disposed inside the bed body, each of the inner supporting assemblies includes an inner supporting structure and a breathable mesh, the top of the inner supporting structure is fixed to an inner wall of the top of the bed body, a side wall of the inner supporting structure is fixed to an inner side wall of the bed body, the inside of the bed body is partitioned into an independent main cavity and an auxiliary cavity surrounding the main cavity by the inner supporting structure, the breathable mesh is mounted on the side wall of the inner supporting structure, the main cavity communicates with the auxiliary cavity through the breathable mesh, a built-in air pump includes a mounting plate and a pump body, the mounting plate is mounted on an inner side wall of the perimeter wall, and the pump body is built in the main cavity.

By adopting the above-mentioned technical solution, the auxiliary cavity can enhance the strength around the bed body. During use, a situation that a user or items located on the bed body slide down from the bed body due to the collapse around the bed body is not easy to occur, and comfort and safety in use are achieved. At the same time, the deformability of the inner supporting structure is higher than the deformability of the breathable mesh, and therefore, when the inner supporting structure is connected to the bed body, the effect of fitting the inner supporting structure to the bed body is good, the strength of a connection position is high, cracks or direct separation or other situations are not easy to occur on the connection position, and the service life is long. At the same time, the breathable mesh is disposed on the inner supporting structure, the intercommunication between the main cavity and the auxiliary cavity is achieved by mesh openings in the breathable mesh, the deformability of the breathable mesh is relatively weak, and the breathable mesh plays a role in enhancing the strength of the inner supporting structure and can provide a stable tension, thereby effectively inhibiting the extensibility and malleability of the inner supporting structure and the bed body. The inner supporting structure is not easy to deform when being tensioned, the phenomena of swelling and bulging around the bed body due to tension failure or excessive air pressure or other factors are not easily caused, and the bed body is high in stability, long in service life, and high in comfort in use. The mounting plate is used for bearing the pump body, and the supporting rod can support an area where a built-in air pump is located to reduce the situation that the user applies an overhigh pressure to the built-in air pump to damage the built-in air pump when using the bed body.

Preferably, inner supporting structure is formed by connecting a plurality of support sheets end to end.

By adopting the above-mentioned technical solution, the inner supporting structure is formed by connecting the plurality of support sheets end to end, and therefore, the breathable meshes can be synchronously assembled on the plurality of support sheets, and then, the support sheets loaded with the breathable meshes are combined together to form the inner supporting structure. The assembly efficiency is higher, and the assembly is more convenient.

Preferably, side walls of the support sheets are provided with assembling through-holes of which shapes and sizes are adapted to shapes and sizes of the breathable meshes, a folded portion is disposed between two adjacent support sheets, and a section of the folded portion is set to be trapezoid.

By adopting the above-mentioned technical solution, when the support sheets are processed, the assembling through-holes are reserved, and then, it is convenient to mount the breathable meshes; the folded portion can enhance the strength of connection between two adjacent support sheets; and at the same time, the section of the folded portion is set to be trapezoid so as to be high in stability, strong in supporting performance, and remarkable in pressure resistance.

Preferably, four corners of the inner supporting structure are all provided with reinforcing airbags, and the reinforcing airbags are used for supporting four corners of the bed body.

By adopting the above-mentioned technical solution, since air volumes of the four corners of the bed body are smaller, when a user sits on the four corners of the bed body, the four corners of the bed body are easier to collapse. Therefore, by disposing the four reinforcing airbags at the four corners of the bed body, the structural strength of a weakest part of the bed body can be improved.

Preferably, the side wall of the inner supporting structure is provided with gas ports, the gas ports communicate with the reinforcing airbags, one-way air nozzles are mounted at the gas ports, the inner side wall of the bed body is provided with locating slots, and side walls of the reinforcing airbags abut against and matched with side walls of the locating slots.

By adopting the above-mentioned technical solution, side walls of the reinforcing airbags abut against and matched with side walls of the accommodating slots, thereby limiting the displacement of the reinforcing airbags in a horizontal direction, and further improving the stability of the reinforcing airbags. Side walls of the reinforcing airbags abut against and matched with side walls of the accommodating slots, thereby limiting the displacement of the reinforcing airbags in a horizontal direction, and further improving the stability of the reinforcing airbags.

Preferably, the side wall of the inner supporting structure is provided with gas ports, the gas ports communicate with the reinforcing airbags, one-way air nozzles are mounted at the gas ports, the inner side wall of the bed body is provided with locating slots, and side walls of the reinforcing airbags abut against and matched with side walls of the locating slots.

By adopting the above-mentioned technical solution, volumes of the reinforcing airbags are smaller, gases are delivered into the reinforcing airbags through the one-way air nozzles only after inflation for the main cavity and the auxiliary cavity is completed, the one-way air nozzles can reduce the situation that gases entering the reinforcing airbags easily flow out from the main cavity because the reinforcing airbags are extruded, and then, the structural strength of the reinforcing airbags can be ensured.

Preferably, an upper surface of the bed body is provided with flock embossing, a side wall of the mounting plate is provided with a supporting rod, and the supporting rod is used for supporting inner walls of the top sheet and the bottom sheet.

By adopting the above-mentioned technical solution, by implanting the flock embossing into the surface of the bed body, the water absorption property, waterproofness and retractility of the bed body can be indirectly improved, and arc-shaped plates can disperse a pressure borne during uniform dispersion, and have good pressure resistance.

Preferably, an upper surface of the bed body is provided with a bedcover, the bedcover covers an upper surface of the top sheet, and the bedcover is detachably connected to the top sheet.

By adopting the above-mentioned technical solution, the detachable bedcover can be replaced with a bedcover with a different material and thickness according to seasonal variation, for example, a cotton and linen bedcover with good breathability is used in summer, and a velvet bedcover with good heat retention properties is used in winter, so that temperature variation in different seasons are adapted, the comfort is improved, various use scenarios can be adapted, and demands of different users are satisfied.

Preferably, the bedcover includes a skin-friendly top layer, a filling layer, a base layer, and a binding, the skin-friendly top layer, the filling layer and the base layer are set to be stacked from top to bottom, the skin-friendly top layer, the filling layer and the base layer are enclosed by the binding, and an inner wall of the binding is fixed to outer side walls of the skin-friendly top layer, the filling layer and the base layer.

By adopting the above-mentioned technical solution, the skin-friendly top layer is in direct contact with the skin, and can provide excellent comfort and ensure that a user has good sleep experience. By disposing the filling layer, the external cold and heat can be effectively isolated, the temperature of the bed body can be kept, and the heat insulation properties of the bedcover can be improved. The base layer can prevent the bed body from being worn, prolong the service life of the bed body, also prevent a filler inside the bed body from being externally exposed, and keep the bed body clean. Due to the design of the binding, an edge of the bedcover is neater, the beauty of the bedcover is increased, at the same time, the displacement of the skin-friendly top layer, the filling layer and the base layer is avoided, and the shape of the bedcover is kept.

Preferably, a connecting zipper is disposed between the bedcover and the top sheet, the connecting zipper includes an upper zipper tape, a lower zipper tape, and a zipper slider, the upper zipper tape is fixed to a side wall of the binding, the lower zipper tape is fixed to a surface of the top sheet, and the zipper slider is used for zipping the upper zipper tape and the lower zipper tape.

By adopting the above-mentioned technical solution, the upper zipper tape of the connecting zipper is fixed to the side wall of the binding, the lower zipper tape is fixed to the surface of the top sheet, and the zipper slider is used for zipping the upper zipper tape and the lower zipper tape, so that tight connection between the bedcover and the top sheet is ensured, and at the same time, the bedcover is conveniently detached and cleaned.

In conclusion, the present application can achieve at least one of following beneficial technical effects.

1. Swelling, bulging and other phenomena around the bed body due to tension failure or excessive air pressure or other factors are not easily caused, and the bed body is high in stability, long in service life, and high in comfort in use.
2. By disposing the four reinforcing airbags at the four corners of the bed body, the structural strength of a weakest part of the bed body can be improved.
3. By form the flock embossing on the surface of the bed body, the water absorption property, waterproofness and retractility of the bed body can be indirectly improved.

DETAILED DESCRIPTION

The present application will be further described in detail below in conjunction with the accompanying FIGS. 1 to 10.

Embodiment 1

Figure 1:
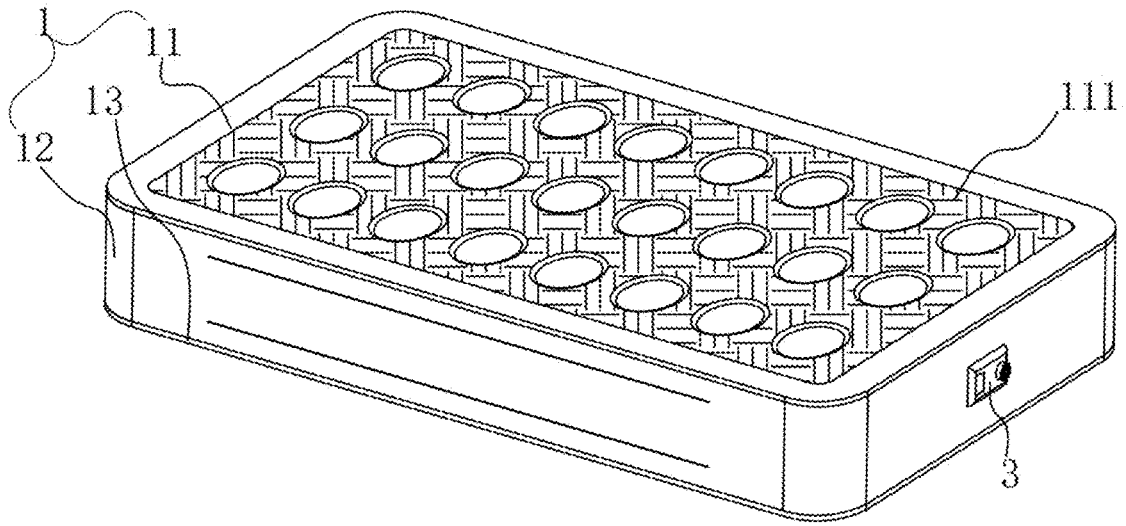
FIG. 1 is a schematic overall structural view of Embodiment 1 of the present application.
Figure 2:
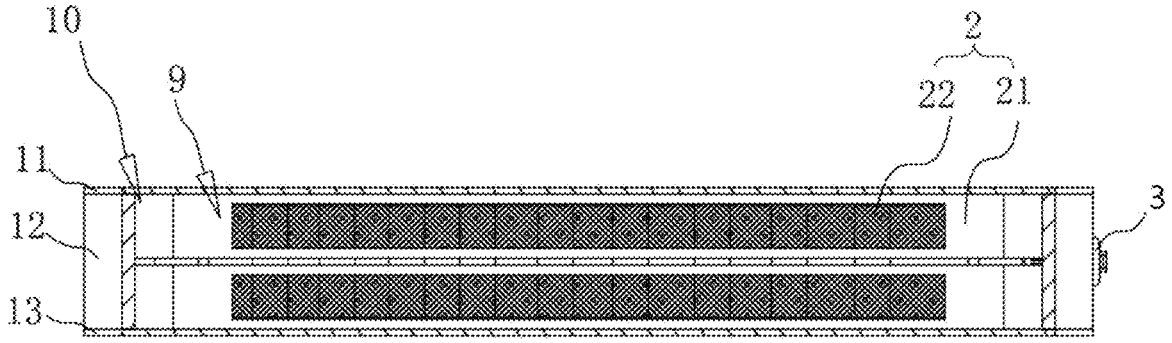
FIG. 2 is a partial sectional view of Embodiment 1 of the present application.

An embodiment of the present application disclosure discloses an inflatable bed. Refer to FIG. 1 and FIG. 2, the inflatable bed includes a bed body 1, the bed body 1 includes a top sheet 11, a perimeter wall 12, a bottom sheet 13, and tensioning straps 4 (see FIG. 3), the top sheet 11 and the bottom sheet 13 are both disposed like a sheet, the perimeter wall 12 is open, the top sheet 11 and the bottom sheet 13 cover the perimeter wall 12 up and down and are fixed to the perimeter wall 12 by hot melting to form a cuboid-like structure. There are a plurality of tensioning straps 4, one end of each of the tensioning straps 4 is fixed to a side wall of the top sheet 11, the other ends of the tensioning straps 4 are fixed to a side wall of the bottom sheet 13, and the plurality of tensioning straps 4 are matched to play a role in stabilizing the bed body 1. In the present embodiment, the bed body 1 can be made of a PVC material, has certain deformability and can be adaptively adjusted in form during use so as not to be easily damaged. In the present embodiment, the tensioning straps 4 are set to be of rectangular-ambulatory-plane structures, rectangular ambulatory planes are connected to the top sheet 11 and the bottom sheet 13 in a length direction, the top sheet 11 is in contact with a human body to achieve concave-convex comfort, and the bottom sheet 13 is abutted against the ground to achieve stability. In other embodiments, the tensioning straps 4 can also be set to be shaped like spiral ropes or flat wires. At the same time, flock embossing 111 is formed on an upper surface of the top sheet 11, so that the water absorption property, waterproofness and retractility of the bed body 1 can be indirectly improved.

On the other hand, two sets of inner supporting assemblies 2 are disposed inside the bed body 1, and the two sets of inner supporting assemblies 2 are symmetrically disposed about the bed body 1. Specifically, each of the inner supporting assemblies 2 includes an inner supporting structure 21 and a breathable mesh 22, the top of the inner supporting structure 21 is fixed to an inner wall of the top of the bed body 1, a side wall of the inner supporting structure 21 is fixed to an inner side wall of the bed body 1, and the inside of the bed body 1 is partitioned into an independent main cavity and an auxiliary cavity surrounding the main cavity by the inner supporting structure 21.

Correspondingly, in the present embodiment, the inner supporting structure 21 is disposed as a PVC film or a thermoplastic urethane (TPU) film, so that the inner supporting structure 21 has certain malleability and can be adaptively adjusted in form during use so as not to be easily damaged. At the same time, the inner supporting structure 21 is good in fitting effect, high in welding firmness, not easy to crack in weld joint and long in service life when being thermally welded with the bed body 1.

Figure 3:
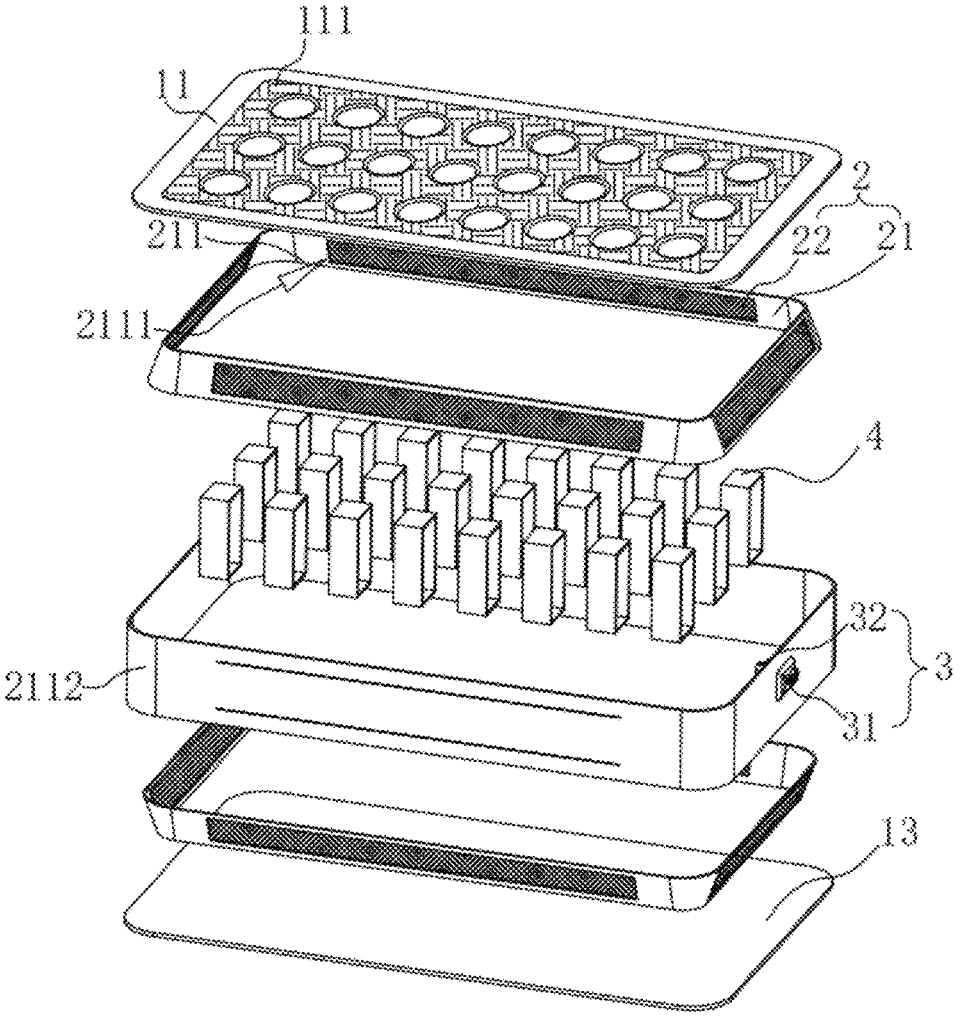
FIG. 3 is a schematic assembly view of Embodiment 1 of the present application.

Refer to FIG. 2 and FIG. 3, further, the inner supporting structure 21 includes four support sheets 211 which are sequentially connected end to end, a folded portion 2112 is formed at a connection of adjacent support sheets 211, and thus, the inner supporting structure 21 has four folded portions 2112 in total, and the four folded portions 2112 are spaced in a circumferential direction of the inner supporting structure 21. The four support sheets 211 are spliced end to end, and the folded portion 2112 is formed at the connection between the two adjacent support sheets 211, so that the folded portion 2112 of the inner supporting structure is shaped like an isosceles trapezoid when being unfolded and is high in stability, strong in supporting performance, and remarkable in pressure resistance.

On the other hand, each of the support sheets 211 is provided with a rectangular assembling through-hole 2111, there is one folded portion 2112 between two adjacent assembling through-holes 2111, each of the support sheets 211 is provided with a rectangular breathable mesh 22, and each of the breathable meshes 22 shields the corresponding assembling through-hole 2111, so that the main cavity communicates with the auxiliary cavity through mesh openings in the breathable mesh 22. It should be understood that the breathable mesh 22 can be fixed to the inner supporting structure 21 by thermal welding, and the breathable mesh 22 is firmly combined with the inner supporting structure 21. In the present embodiment, the inner supporting structure 21 can be formed by respectively welding the four support sheets 211 end to end, that is, the four independent support sheets 211 are processed firstly, then, the four support sheets 211 are spliced end to end, and thermal welding is performed at an end-to-end splicing part.

In addition, when the breathable mesh 22 and the inner supporting structure 21 are assembled, the breathable mesh 22 can be thermally welded on the inner supporting structure 21 firstly, then, corresponding positions on the inner supporting structure 21 are cut according to a shape of an outer contour of the breathable mesh 22 to form the assembling through-holes 2111, and the mesh openings in the breathable mesh 22 are located in an area defined by the assembling through-holes 2111, and the mesh openings can drive the main cavity and the auxiliary cavity. If the breathable mesh 22 and the inner supporting structure 21 are assembled in such a way, before thermal fixation, the inner supporting structure 21 is of an overall structure and is not provided with the assembling through-holes 2111, so that the structural strength is high, deformation is not easy to occur, a good locating effect and more tight combination with the breathable mesh 22 are achieved, and the firmness of connection between the breathable mesh 22 and the inner supporting structure 21 is improved. The assembling through-holes 2111 are formed by processing after the breathable mesh 22 is fixed to the inner supporting structure 21, and it is not easy to misplace the breathable mesh 22 and the assembling through-holes 2111, and the matching quality is high.

In the present embodiment, the breathable mesh 22 is made of a fiber material, that is, the breathable mesh 22 is a fiber mesh, for example, the breathable mesh 22 can be a chemical fiber mesh, a polyester mesh, etc.

In addition, a side wall of the bed body 1 is provided with a built-in air pump 3, and the built-in air pump 3 is used for inflation. Specifically, the built-in air pump 3 includes a mounting plate 31 and a pump body 32, the mounting plate 31 is mounted on the side wall of the bed body 1, and the pump body 32 is built in the main cavity.

The inflatable bed in the embodiment of the present application is implemented based on a principle that, during use, a sufficient amount of gases can be filled into the main cavity by means of the pump body 32, and the gases in the main cavity can directly enter the auxiliary cavity through the mesh openings in the breathable mesh 22, so that air pressures of the main chamber and the auxiliary cavity are kept consistent. The auxiliary cavity is disposed around the main cavity and is located around the bed body 1 so as to be capable of enhancing the strength around the bed body 1. During use, great collapse around the bed body 1 is not easy to occur, a situation that a user or items located on the bed body 1 slide down from the bed body 1 due to the collapse around the bed body 1 can be avoided, and comfort and safety in use are achieved. After inflation is completed, the inner supporting structure 21 and the breathable mesh 22 are matched to provide a tension, so that the shape of the bed body 1 is kept fixed. It should be understood that the deformability of the inner supporting structure 21 is higher than the deformability of the breathable mesh 22, and therefore, when the inner supporting structure 21 is connected to the bed body 1, the effect of fitting the inner supporting structure 21 to the bed body 1 is good, the strength of a connection position is high, cracks or direct separation or other situations are not easy to occur on the connection position, and the service life is long. At the same time, the breathable mesh 22 is disposed on the inner supporting structure 21, the intercommunication between the main cavity and the auxiliary cavity is achieved by the mesh openings in the breathable mesh 22, the deformability of the breathable mesh 22 is relatively weak, and the breathable mesh 22 plays a role in enhancing the strength of the inner supporting structure 21 and can provide a stable tension, thereby effectively inhibiting the extensibility and malleability of the inner supporting structure 21 and the bed body 1. The inner supporting structure 21 is not easy to deform when being tensioned, the phenomena of swelling and bulging around the bed body 1 due to tension failure or excessive air pressure or other factors are not easily caused, and the bed body 1 is high in stability, long in service life, and high in comfort in use.

Embodiment 2

Figure 4:
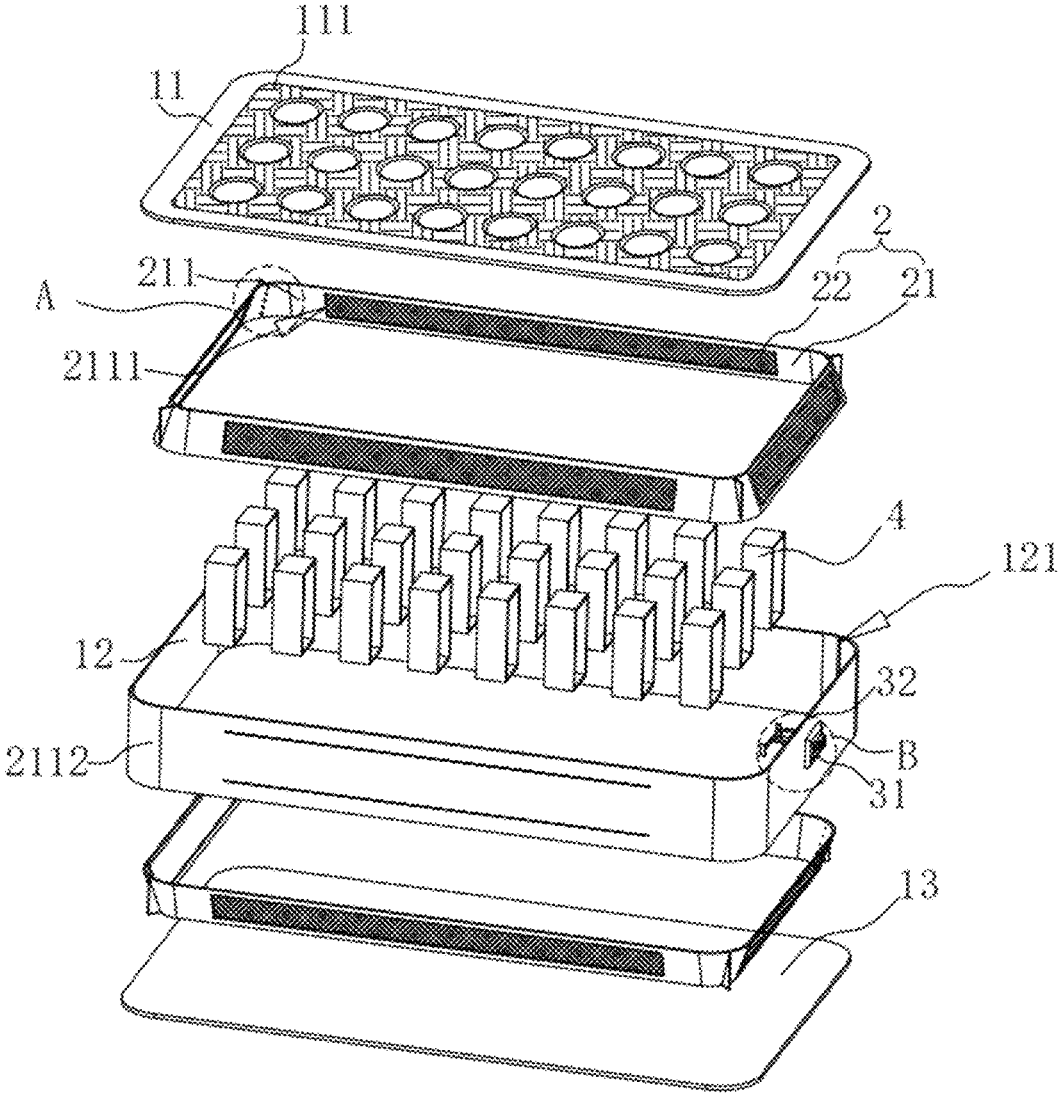
FIG. 4 is a schematic assembly view of Embodiment 2 of the present application.
Figure 5:
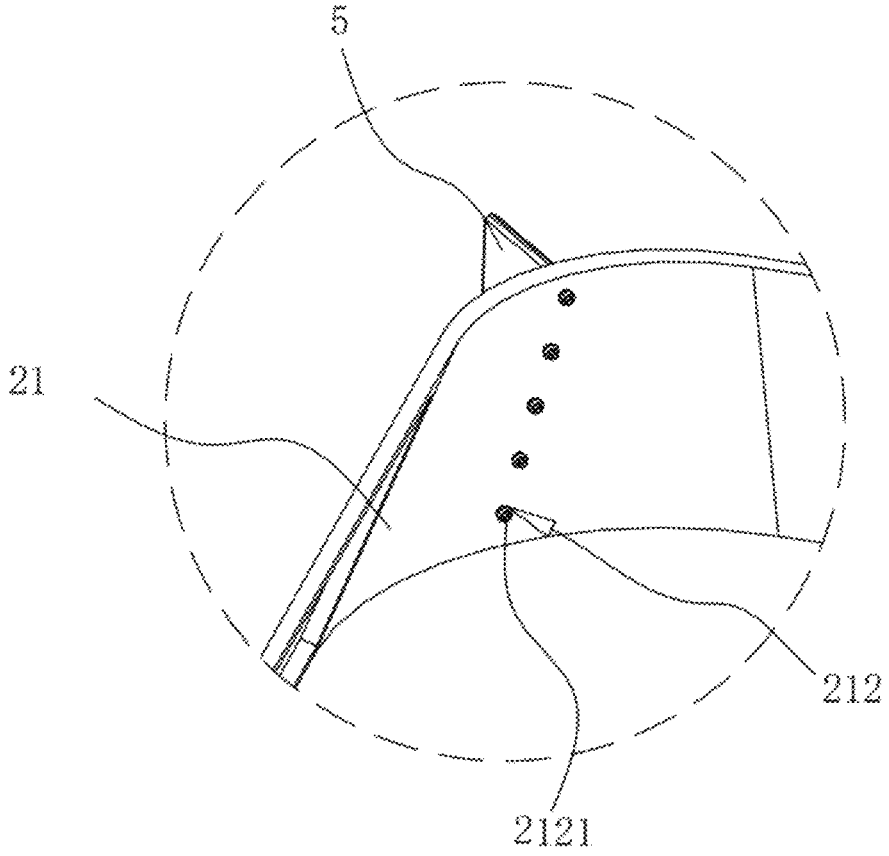
FIG. 5 is a schematic enlarged view of Portion A in FIG. 3.

Refer to FIG. 4 and FIG. 5, the embodiment is different from Embodiment 1 in that four corners of the inner supporting structure 21 are all provided with reinforcing airbags 5, and the reinforcing airbags 5 are used for supporting four corners of the bed body 1. In the present embodiment, the reinforcing airbags 5 are also made of a PVC film or TPU film, are of film-like structures with unilateral openings, and are fixed to the inner supporting structure 21 by thermal welding.

Correspondingly, the side wall of the inner supporting structure 21 is provided with gas ports 212, the gas ports 212 communicate with the reinforcing airbags 5, and one-way air nozzles 2121 are mounted at the gas ports 212. Since volumes of the reinforcing airbags 5 are smaller, gases are delivered into the reinforcing airbags 5 through the one-way air nozzles 2121 only after inflation for the main cavity and the auxiliary cavity is completed, the one-way air nozzles 2121 can reduce the situation that gases entering the reinforcing airbags 5 easily flow out from the main cavity because the reinforcing airbags 5 are extruded, and then, the structural strength of the reinforcing airbags 5 can be ensured.

In addition, with the increase of service time, a small amount of partial gases in the reinforcing airbags 5 can also flow out from the one-way air nozzles 2121. Therefore, during repeated use, the gases in the reinforcing airbags 5 can be supplemented when the main cavity and the auxiliary cavity are inflated.

Further, sections of the reinforcing airbags 5 are set to be triangular, and triangular structures have certain stability, so that the structural stability of the reinforcing airbags 5 is further improved. In addition, an inner side wall of the perimeter wall 12 is provided with locating slots 121 in a vertical direction, and side walls of the reinforcing airbags 5 abut against and matched with side walls of the locating slots 121, thereby limiting the displacement of the reinforcing airbags 5 in a horizontal direction, and further improving the stability of the reinforcing airbags 5. When the inflatable bed is inflated repeatedly, the reinforcing airbags 5 are inserted into the locating slots 121 to play a role in location. At the same time, when the inflatable bed is stored, the reinforcing airbags 5 can retain original triangular plate-like structures, which is convenient for a user to rapidly recognize positions of the four corners of the inflatable bed to achieve rapid storage during storage. In addition, after the inflatable bed is stored, the reinforcing airbags 5 can play an inner supporting role and provide a certain shaping ability for an overall structure of the stored and folded inflatable bed to reduce the situation that the folded inflatable bed is softer and needs to be supported when being fetched by the user, thereby further improving the user convenience of the inflatable bed.

Figure 6:
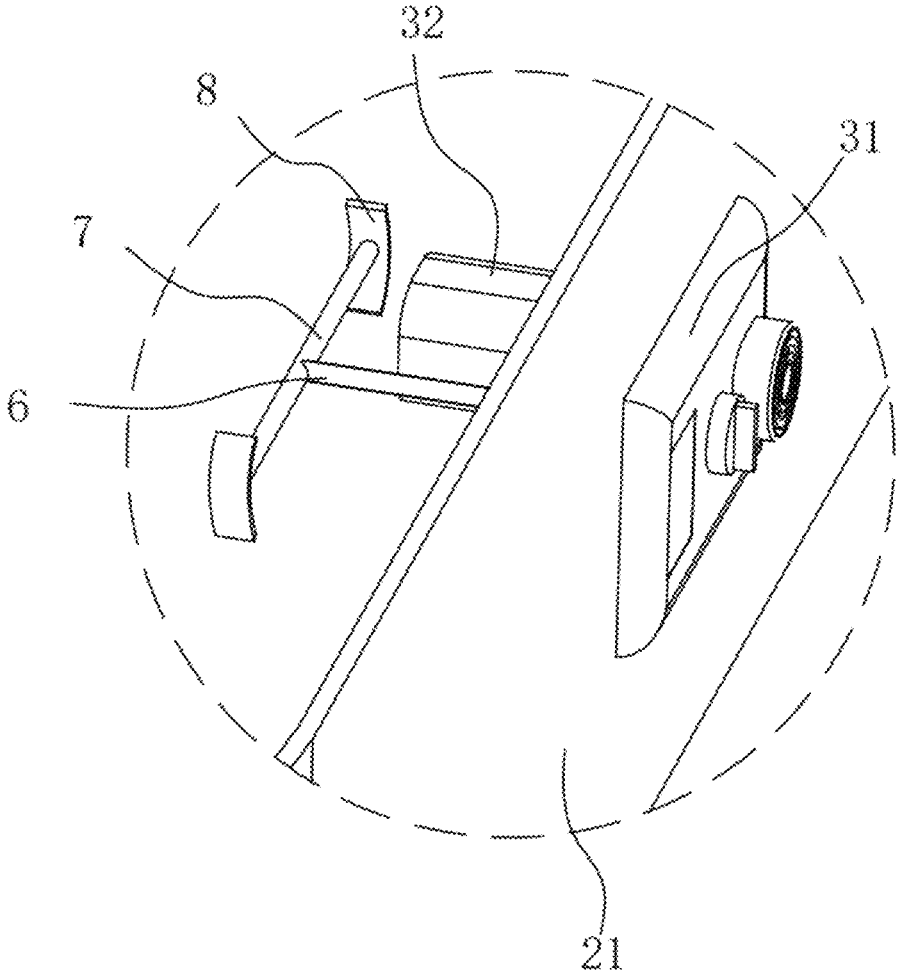
FIG. 6 is a schematic enlarged view of Portion B in FIG. 3.

Refer to FIG. 4 and FIG. 6, on the other hand, a connecting rod 6 is rotatably borne on the side wall of the mounting plate 31 and is disposed in a length direction of the bed body 1, one end of the connecting rod 6 penetrates out of the mounting plate 31 on which a self-locking knob is disposed, and the connecting rod 6 is coaxially fixed to the self-locking knob. At the same time, an end of the connecting rod 6 is vertically fixed with a supporting rod 7, and the supporting rod 7 is used for supporting upper and lower inner walls of the bed body 1. Specifically, ends of the supporting rod 7 are fixed with arc-shaped plates 8, and side walls of the arc-shaped plates 8 abut against and matched with the inner wall of the bed body 1.

Therefore, the mounting plate 31 is used for bearing the pump body 32, the supporting rod 7 is matched with the arc-shaped plates 8 to support an area where the built-in air pump 3 is located, and the arc-shaped plates 8 can disperse a pressure borne during uniform dispersion, have good pressure resistance, and reduce the situation that the user applies an overhigh pressure to the built-in air pump 3 to damage the built-in air pump 3 when using the bed body 1. At the same time, by rotating the connecting rod 6, an angle of the supporting rod 7 can be changed, and when the inflatable bed is deflated and stored, space relatively occupied by the supporting rod 7 can be reduced.

The embodiment of the present application is implemented based on the approximately same principle as Embodiment 1 so as not to be repeated too much herein.

Embodiment 3

Figure 7:
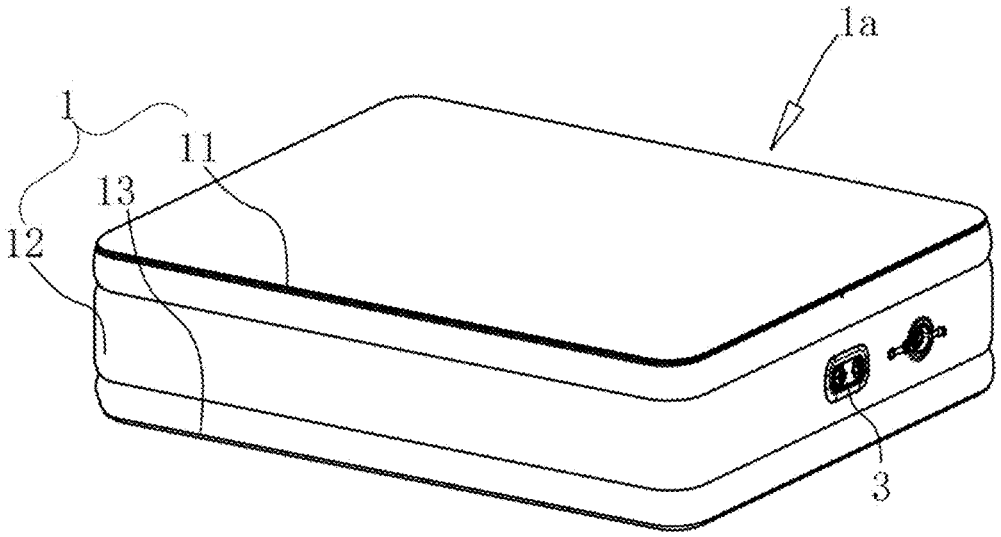
FIG. 7 is a schematic overall structural view of Embodiment 3 of the present application.
Figure 8:
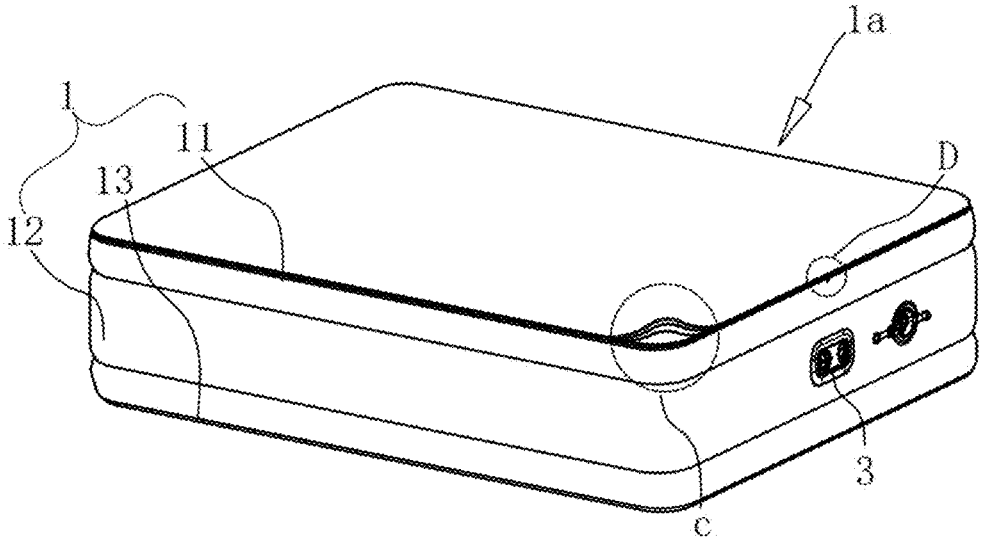
FIG. 8 is a schematic view of an inflatable bed in Embodiment 3 of the present application, in which part of a bedcover is raised.

Refer to FIG. 7 and FIG. 8, the embodiment is different from Embodiment 1 in that an upper surface of the bed body 1 is provided with a bedcover 1*a*, the bedcover 1*a* covers an upper surface of the top sheet 11, and the bedcover 1*a* is detachably connected to the top sheet 11.

Correspondingly, the detachable bedcover 1*a* can be replaced with a bedcover 1*a* with a different material and thickness according to seasonal variation, for example, a cotton and linen bedcover with good breathability is used in summer, and a velvet bedcover with good heat retention properties is used in winter, so that temperature variation in different seasons are adapted, the comfort is improved, various use scenarios can be adapted, and demands of different users are satisfied.

Figure 9:
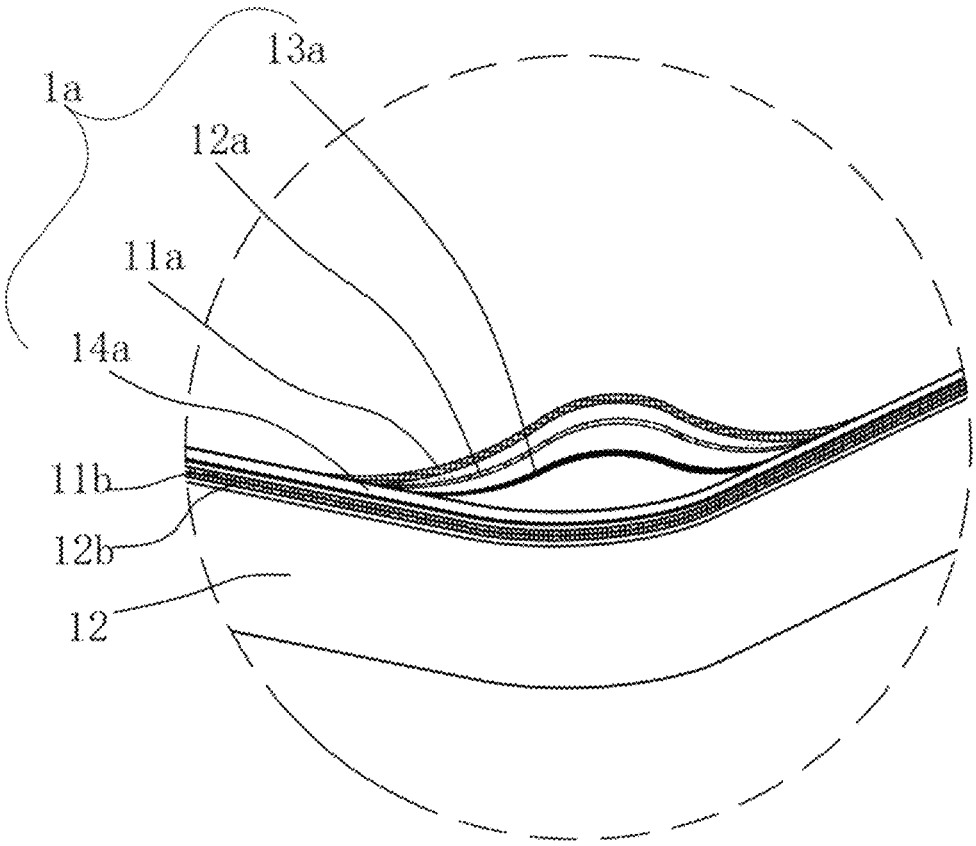
FIG. 9 is a schematic enlarged view of Portion C in FIG. 8.

Refer to FIG. 8 and FIG. 9, further, the bedcover 1*a* includes a skin-friendly top layer 11*a*, a filling layer 12*a*, a base layer 13*a*, and a binding 14*a*, the skin-friendly top layer 11*a*, the filling layer 12*a* and the base layer 13*a* are set to be stacked from top to bottom, the skin-friendly top layer 11*a*, the filling layer 12*a* and the base layer 13*a* are enclosed by the binding 14*a*, and an inner wall of the binding 14*a* is fixed to outer side walls of the skin-friendly top layer 11*a*, the filling layer 12*a* and the base layer 13*a*.

It should be noted that the skin-friendly top layer 11*a* is in direct contact with the skin, and therefore, a soft, breathable and skin-friendly material should be selected. For example, pure cotton, bamboo fiber, tencel, and other natural fibers can be adopted. In the embodiment of the present application, the skin-friendly top layer 11*a* is made of the pure cotton which is capable of effectively absorbing sweat on the surface of the skin, keeping the skin dry and comfortable, also having the characteristics of softness and skin friendliness and providing excellent comfort.

In addition, by disposing the filling layer 12*a*, external cold and heat can be effectively isolated, the temperature of the bed body 1 can be kept, and heat insulation properties of the bedcover 1*a* can be improved. For example, down, wool, memory cotton, latex and other materials can be adopted. In the present embodiment, the filling layer 12*a* is made of the memory cotton capable of effectively isolating the external cold and heat, keeping the temperature of the bed body 1, also having the characteristics of softness and elasticity and providing good support and comfort.

Therefore, the skin-friendly top layer 11*a* is in direct contact with the skin, and can provide excellent comfort and ensure that a user has good sleep experience. By disposing the filling layer 12*a*, the external cold and heat can be effectively isolated, the temperature of the bed body 1 can be kept, and the heat insulation properties of the bedcover 1*a* can be improved. The base layer 13*a* can prevent the bed body 1 from being worn, prolong the service life of the bed body 1, also prevent a filler inside the bed body 1 from being externally exposed, and keep the bed body 1 clean. Due to the design of the binding 14*a*, an edge of the bedcover 1*a* is neater, the beauty of the bedcover 1*a* is increased, at the same time, the displacement of the skin-friendly top layer 11*a*, the filling layer 12*a* and the base layer 13*a* is avoided, and the shape of the bedcover 1*a* is kept.

Figure 10:
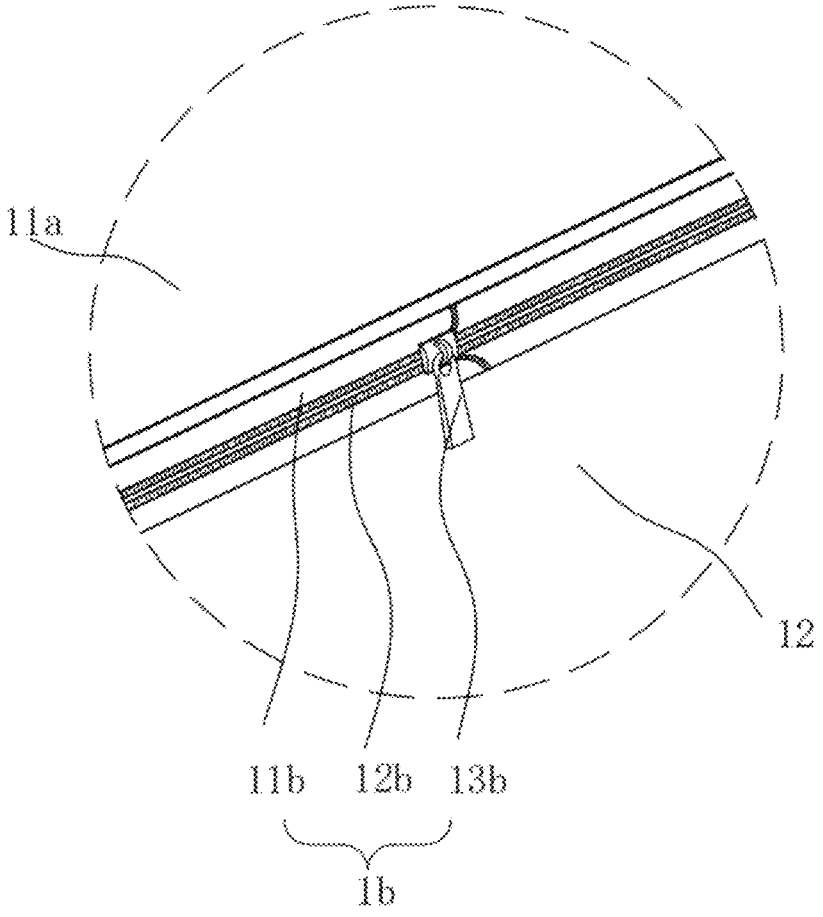
FIG. 10 is a schematic enlarged view of Portion D in FIG. 8.

Refer to FIG. 8 and FIG. 10, on the other hand, a connecting zipper 1*b* is disposed between the bedcover 1*a* and the top sheet 11, the connecting zipper 1*b* includes an upper zipper tape 11*b*, a lower zipper tape 12*b*, and a zipper slider 13*b*, the upper zipper tape 11*b* is fixed to a side wall of the binding 14*a*, the lower zipper tape 12*b* is fixed to a surface of the top sheet 11, and the zipper slider 13*b* is used for zipping the upper zipper tape 11*b* and the lower zipper tape 12*b*.

Therefore, the upper zipper tape 11*b* of the connecting zipper 1*b* is fixed to the side wall of the binding 14*a*, the lower zipper tape 12*b* is fixed to the surface of the top sheet 11, and the zipper slider 13*b* is used for zipping the upper zipper tape 11*b* and the lower zipper tape 12*b*, so that tight connection between the bedcover 1*a* and the top sheet 11 is ensured, and at the same time, the bedcover 1*a* is conveniently detached and cleaned.

It should be noted that the connecting zipper 1*b* in the embodiment of the present application is correspondingly provided with two ends, i.e., a head and a tail of the connecting zipper 1*b*. After the head and the tail of the connecting zipper 1*b* are enclosed, the head of the connecting zipper 1*b* further extends forwards and correspondingly covers an outer side of the tail of the connecting zipper 1*b*, so that the tail of the connecting zipper 1*b* is isolated from an external environment to play a protection role. At the same time, when the inflatable bed is inflated, both the bedcover 1*a* and the bed body 1 deform, at the moment, the head of the connecting zipper 1*b* may move due to the above-mentioned deformation, so that cracks appear at a connection between the bedcover 1*a* and the bed body 1. By appropriately extending a segment of the head of the connecting zipper 1*b*, a displacement margin can be provided for the head of the connecting zipper 1*b*, the situation of cracks at the above-mentioned connection between the bedcover 1*a* and the bed body 1 can be reduced, and the stability of connection between the bedcover 1*a* and the bed body 1 can be ensured.

The above descriptions are all preferred embodiments of the present application, but the protection scope of the present application is not limited thereto. Therefore, all equivalent variations made according to the structure, shape and principle of the present application should fall within the protection scope of the present application.

LISTING OF REFERENCE SIGNS

1 Bed Body
11 Top Sheet
111 Flock Embossing
12 Perimeter Wall
121 Locating Slot
13 Bottom Sheet
2 Inner Supporting Assembly
21 Inner Supporting Structure
211 Enclosing Sheet
2111 Assembling Through-Hole
2112 Folded Portion
212 Gas Port
2121 One-Way Air Nozzle
22 Breathable Mesh
3 Built-In Air Pump
31 Mounting Plate
32 Pump Body
4 Tensioning Strap
5 Reinforcing Airbag
6 Connecting Rod
7 Supporting Rod
8 Arc-Shaped Plate
9 Main Cavity
10 Auxiliary Cavity
1*a* Bedcover
11*a* Skin-Friendly Top Layer
12*a* Filling Layer
13*a* Base Layer
14*a* Binding
1*b* Connecting Zipper
11*b* Upper Zipper Tape
12*b* Lower Zipper Tape
13*b* Zipper Slider

What is claimed is:

1. An inflatable bed, comprising a bed body, wherein the bed body is hollow, the bed body comprises a top sheet, a perimeter wall, a bottom sheet, and tensioning straps, the top sheet and the bottom sheet cover the perimeter wall, inner supporting assemblies are disposed inside the bed body, each of the inner supporting assemblies comprises an inner supporting structure and a breathable mesh, a top of the inner supporting structure is fixed to an inner wall of a top of the bed body, a side wall of the inner supporting structure is fixed to an inner side wall of the bed body, an interior of the bed body is partitioned into an independent main cavity and an auxiliary cavity surrounding the independent main cavity by the inner supporting structure, the breathable mesh is mounted on the side wall of the inner supporting structure, and the independent main cavity is in communication with the auxiliary cavity through the breathable mesh, wherein the inner supporting structure is formed by connecting a plurality of support sheets end to end, and a side wall of the support sheets is provided with assembling through-holes with shapes and sizes corresponding to shapes and sizes of the breathable meshes, a folded portion is disposed between two adjacent support sheets of the support sheets, and the folded portion has a trapezoidal cross section.

2. The inflatable bed according to claim 1, wherein four corners of the inner supporting structure are all provided with reinforcing airbags, and the reinforcing airbags are configured for supporting four corners of the bed body.

3. The inflatable bed according to claim 2, wherein the side wall of the inner supporting structure is provided with gas ports, the gas ports communicate with the reinforcing airbags, one-way air nozzles are mounted at the gas ports, the inner side wall of the bed body is provided with locating slots, and side walls of the reinforcing airbags abut against side walls of the locating slots.

4. The inflatable bed according to claim 1, wherein an upper surface of the bed body is provided with flock embossing, ends of a supporting rod are fixed with arc-shaped plates, and side walls of the arc-shaped plates abut against the inner wall of the top of the bed body.

5. The inflatable bed according to claim 4, wherein a built-in air pump comprises a mounting plate and a pump body, the mounting plate is mounted on an inner side wall of the perimeter wall, the pump body is built in the independent main cavity, a side wall of the mounting plate is provided with the supporting rod, and the supporting rod is configured for supporting inner walls of the top sheet and the bottom sheet.

6. The inflatable bed according to claim 1, wherein an upper surface of the bed body is provided with a bedcover, the bedcover covers an upper surface of the top sheet, and the bedcover is detachably connected with the top sheet.

7. The inflatable bed according to claim 6, wherein the bedcover comprises a skin-friendly top layer, a filling layer, a base layer, and a binding, the skin-friendly top layer, the filling layer and the base layer are stacked one on another, the skin-friendly top layer, the filling layer and the base layer are surrounded by the binding, and an inner wall of the binding is fixed to outer side walls of the skin-friendly top layer, the filling layer and the base layer.

8. The inflatable bed according to claim 7, wherein a connecting zipper is provided between the bedcover and the top sheet, the connecting zipper comprises an upper zipper tape, a lower zipper tape, and a zipper slider, the upper zipper tape is fixed to a side wall of the binding, the lower zipper tape is fixed to a surface of the top sheet, and the zipper slider is used for zipping the upper zipper tape and the lower zipper tape.

9. An inflatable bed, comprising a bed body, wherein the bed body is hollow, the bed body comprises a top sheet, a perimeter wall, a bottom sheet, and tensioning straps, the top sheet and the bottom sheet cover the perimeter wall, inner supporting assemblies are disposed inside the bed body, each of the inner supporting assemblies comprises an inner supporting structure and a breathable mesh, a top of the inner supporting structure is fixed to an inner wall of a top of the bed body, a side wall of the inner supporting structure is fixed to an inner side wall of the bed body, an interior of the bed body is partitioned into an independent main cavity and an auxiliary cavity surrounding the independent main cavity by the inner supporting structure, the breathable mesh is mounted on the side wall of the inner supporting structure, and the independent main cavity is in communication with the auxiliary cavity through the breathable mesh, wherein four corners of the inner supporting structure are all provided with reinforcing airbags, and the reinforcing airbags are configured for supporting four corners of the bed body.

10. The inflatable bed according to claim 9, wherein the side wall of the inner supporting structure is provided with gas ports, the gas ports communicate with the reinforcing airbags, one-way air nozzles are mounted at the gas ports, the inner side wall of the bed body is provided with locating slots, and side walls of the reinforcing airbags abut against side walls of the locating slots.

11. An inflatable bed, comprising a bed body, wherein the bed body is hollow, the bed body comprises a top sheet, a perimeter wall, a bottom sheet, and tensioning straps, the top sheet and the bottom sheet cover the perimeter wall, inner supporting assemblies are disposed inside the bed body, each of the inner supporting assemblies comprises an inner supporting structure and a breathable mesh, a top of the inner supporting structure is fixed to an inner wall of a top of the bed body, a side wall of the inner supporting structure is fixed to an inner side wall of the bed body, an interior of the bed body is partitioned into an independent main cavity and an auxiliary cavity surrounding the independent main cavity by the inner supporting structure, the breathable mesh is mounted on the side wall of the inner supporting structure, and the independent main cavity is in communication with the auxiliary cavity through the breathable mesh, wherein an upper surface of the bed body is provided with flock embossing, ends of a supporting rod are fixed with arc-shaped plates, and side walls of the arc-shaped plates abut against the inner wall of the top of the bed body.

12. The inflatable bed according to claim 11, wherein a built-in air pump comprises a mounting plate and a pump body, the mounting plate is mounted on an inner side wall of the perimeter wall, the pump body is built in the independent main cavity, a side wall of the mounting plate is provided with the supporting rod, and the supporting rod is configured for supporting inner walls of the top sheet and the bottom sheet.

* * * * *